US005596941A

United States Patent [19]

Landen

[11] Patent Number: 5,596,941

[45] Date of Patent: Jan. 28, 1997

[54] LIFTING CONTROL FOR SLIDABLE PRESSER FOOT

[75] Inventor: Jan-Olof Landen, Huskvarna, Sweden

[73] Assignee: Aktiebolaget Electrolux, Stockholm, Sweden

[21] Appl. No.: 608,253

[22] Filed: Feb. 28, 1996

[30] Foreign Application Priority Data

Mar. 17, 1995 [SE] Sweden ..... 9500954

[51] Int. Cl.[6] ..... D05B 29/02; D05B 29/08

[52] U.S. Cl. ..... 112/239; 112/235

[58] Field of Search ..... 112/235, 237–239, 112/132–135

[56] References Cited

U.S. PATENT DOCUMENTS

| | | | |
|---|---|---|---|
| 494,224 | 3/1893 | Philbrick | 112/235 |
| 929,686 | 8/1909 | Moffatt | 112/135 |
| 2,548,361 | 4/1951 | Ginwright | 112/234 |
| 3,473,497 | 10/1969 | Cash | 112/239 |
| 3,661,102 | 5/1972 | Tice | 112/239 X |
| 4,454,830 | 6/1984 | Bennett | 112/239 |

FOREIGN PATENT DOCUMENTS

| | | | |
|---|---|---|---|
| 4216054 | 11/1993 | Germany . | |
| 2152498 | 7/1987 | Japan | 112/237 |
| 9301319 | 10/1994 | Sweden . | |
| 372908 | 12/1963 | Switzerland . | |

*Primary Examiner*—Ismael Izaguirre

*Attorney, Agent, or Firm*—Pearne, Gordon, McCoy & Granger

[57] ABSTRACT

An arrangement in a sewing machine including a fabric feed dog (14; 44) for feeding a fabric to be sewn, and a vertically movable presser bar (12; 42) having a presser foot (13; 43; 63) and a presser spring (23; 53). The presser bar is actuatable by a power-driven actuator(19; 49) connected to the presser spring and slidable in parallel with the presser bar. The actuator is movable relative to the presser bar to adjust the presser foot pressure and operatively connected to the presser bar to raise and lower the presser foot during the sewing procedure in accordance with a predetermined program. In one embodiment, the presser foot (13, 43) is slidable to follow the fabric during the feeding step. In another embodiment, the presser foot (63) is provided with a top feed ruffler (69, 70) for forming tucks or pleats in the fabric being sewn.

7 Claims, 6 Drawing Sheets

LIFTING CONTROL FOR SLIDABLE PRESSER FOOT

BACKGROUND OF THE INVENTION

The present invention relates to an arrangement in a sewing machine, comprising a needle bar having a needle, a feed dog for feeding a fabric to be sewn, and a vertically movable presser bar having a presser foot and a presser spring. The presser bar is actuated by a power-driven actuating means connected to the presser spring and slidable in parallel with the presser bar. The actuating means is movable relative to the presser bar to control the presser foot pressure and to engage the presser bar in order to raise and lower the presser foot during the sewing procedure in accordance with a predetermined program.

A conventional, stationary presser foot creates a braking action on an upper fabric layer due to friction between the fabric and the presser foot. The friction results in a risk of mutual displacement of the fabric layers in that the distance of feeding of the upper layer will be shorter than that of the lower layer which is in direct contact with the feed dog. As is easily seen, such mutual displacement of the fabric layers will have a negative effect on the sewing performance. The problem is particularly evident in the case of material providing great friction when engaging the presser foot, but also when sewing soft, compressible fabric material.

In order to provide a solution to the above problem it is known to use an arrangement having a slidably journalled presser foot. Raising movement of the presser foot is provided by the drive mechanism of the needle bar. However, in such an arrangement it is not possible to obtain raising and lowering of the presser foot at the appropriate moments during the sewing procedure, and the performance of the arrangement has therefore not appeared to be satisfactory.

SUMMARY OF THE INVENTION

It is an object of the invention to minimize or eliminate the disadvantages or deficiencies of known arrangements of this kind.

Another object is to provide pleat and tuck sewing by the arrangement according to the invention. To this end an embodiment has been provided in which the presser foot has a top feed ruffler driven by the vertical movement of the presser bar.

A further object is to enable rapid and simple adjustment of the sewing machine between conventional sewing and sewing with the arrangement according to the invention having a raisable presser foot.

In one embodiment of the invention, the presser foot is slidably journalled relative to the presser bar in order to follow the fabric during feeding and adapted to be raised between feeding steps and resiliently actuated in order to, when raised, be returned to an initial position. By such an arrangement it is possible to a great extent to eliminate the braking action exercised by a conventional, stationary presser foot on the upper fabric layer due to friction between the fabric and the presser foot.

In further accordance with the present invention, the presser foot is horizontally movable relative to the presser bar together with the fabric during feeding steps. Actuating means are operable to raise the presser foot independently of the movement of the needle bar. The presser foot is actuated by resilient means in order to, when raised, be returned to an initial position relative to the presser bar.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figures 1, 2, 3, 4:
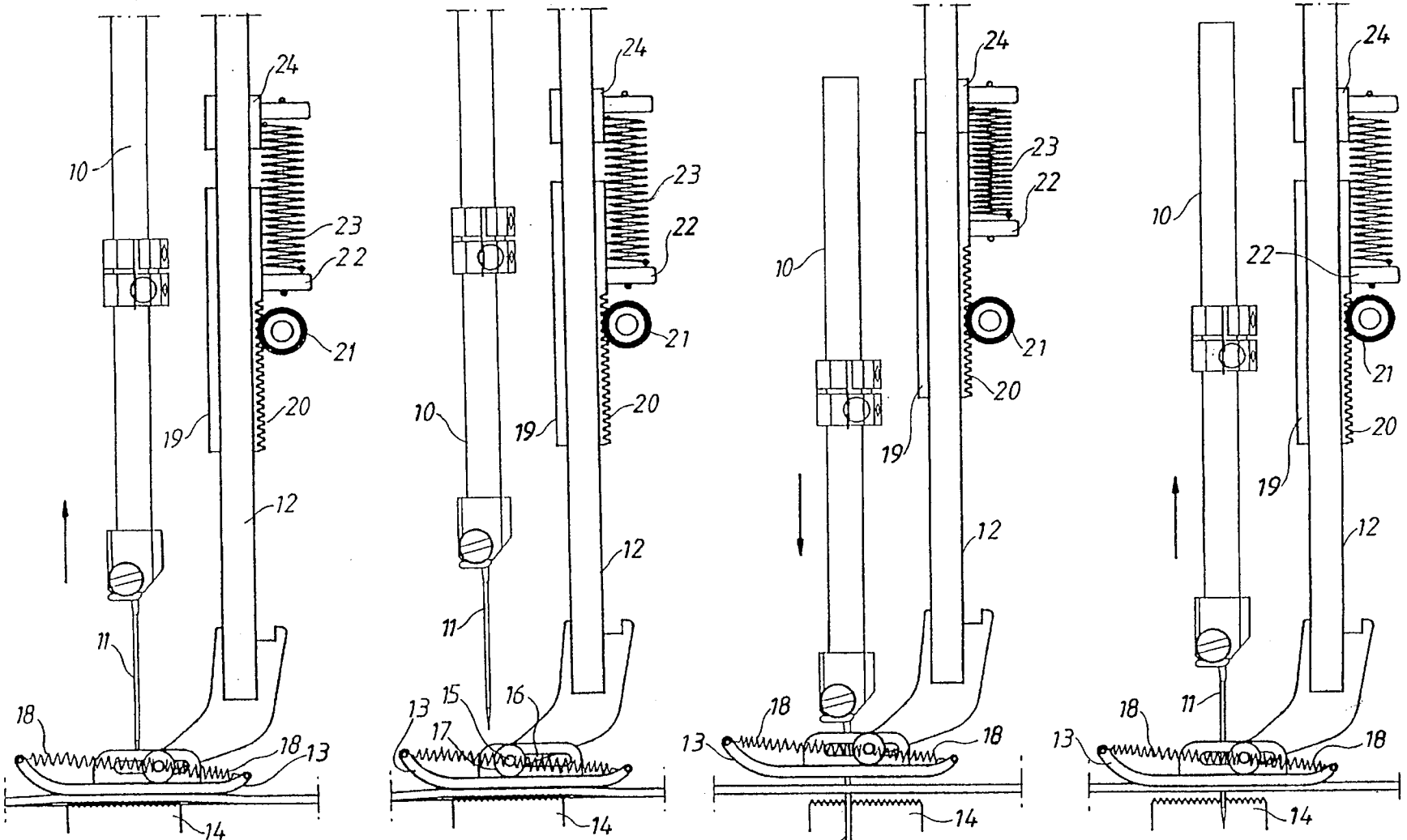
FIGS. 1–4 illustrate diagrammatical side elevational views of a first embodiment of an arrangement according to the present invention, in different positions.

The arrangement shown in FIGS. 1–4 comprises a needle bar 10 having a needle 11, a presser bar 12 having a presser foot 13, and a fabric feed dog 14. The presser foot 13 is slidably supported on a shaft 15 extending through horizontal slots 16 and the shaft 15 is provided with rollers 17 to reduce friction. In order to return the presser foot 13 to an initial position, tension springs 18 are provided which are attached between the shaft 15 and the respective forward and rearward ends of the presser foot, as illustrated.

On the presser bar 12 a slidable sleeve 19 is provided which has a rack 20 engaging a pinion 21 driven by a stepping motor (not shown). The sleeve 19 is also provided with a bracket 22 to which one end of a presser spring 23 is attached. The other end of the spring is attached to a bracket 24 which is fixed to the presser bar 12.

In the stage shown in FIG. 1 the presser foot 13 has been lowered and the presser spring 23 is tensioned by the rack 20 to obtain an appropriate presser foot pressure. The needle 11 has left the fabric and the feed dog 14 has just commenced a feeding movement. In FIG. 2 the feeding movement has been completed whereby the presser foot 13 has been laterally displaced together with the fabric.

In FIG. 3 the needle 11 is shown in a lowermost position and the presser foot 13 is in a raised position and has been returned to its horizontal initial position by action of the springs 18. The presser foot 13 is raised upwards by the sliding sleeve 19 due to operation of the rack 20 and pinion 21, whereby the upper end of the sleeve 19 engages the bracket 24 to raise the presser bar 12. Raising movement of the presser bar 12 is controlled such that the needle 11 penetrates the fabric to fix the same before the presser foot 13 is raised by the sliding sleeve 19.

In FIG. 4 the presser foot 13 is again in its lowered position and the needle 11 is in its upward stroke. The sliding sleeve 19 has moved downwardly due to action of the rack 20 and pinion 21. The presser foot 13 has been lowered and the presser spring 23 has been tensioned to a predetermined presser foot pressure before the needle 11 leaves the fabric. It is thereby ensured that the fabric is held in its correct fixed position during the entire sewing procedure.

Figures 5, 6, 7:
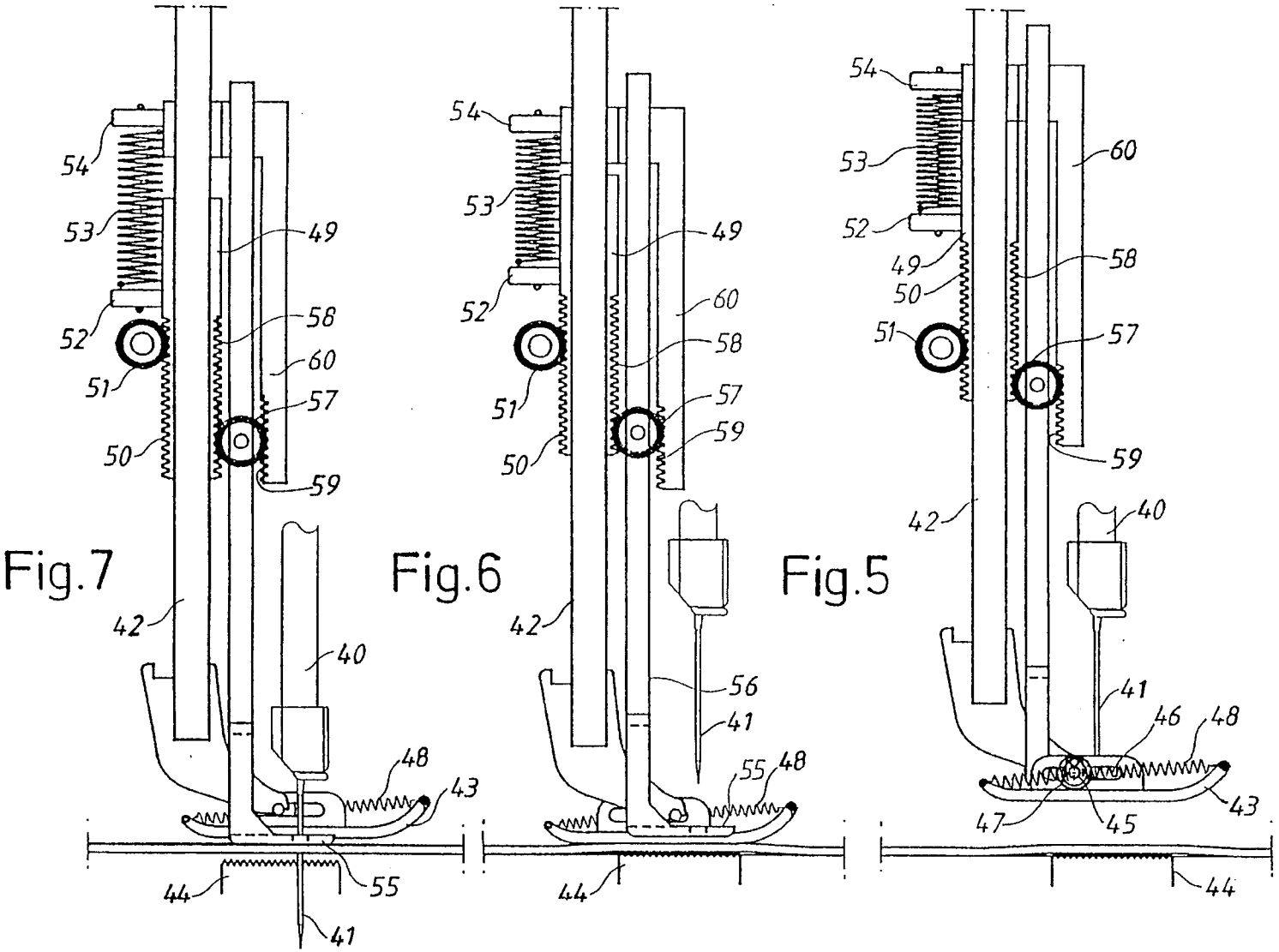
FIGS. 5–7 illustrate diagrammatical side elevational views of a second embodiment of the present invention, in different positions.

A second embodiment of the present invention is shown in FIGS. 5–7, and includes a needle bar 40 having a needle 41, a presser bar 42 having a presser foot 43, and a feed dog 44. The presser foot 43 is slidably supported on a shaft 45 extending through horizontal slots 46 and having rollers 47 and tension springs 48, as have been described hereinbefore with reference to FIGS. 1–4.

The presser bar 42 has a slidable sleeve 49 mounted thereover. The sleeve 49 is provided with a first rack 50 which engages a pinion 51 driven by a stepping motor (not shown). The sleeve 49 includes a bracket 52 to which one end of a presser spring 53 is attached. The other end of the presser spring 53 is attached to a bracket 54 which is fixed to the presser bar 42.

As is best seen in FIGS. 6 and 7, (wherein a portion of the presser foot 43 has been removed for purposes of clarity), a supporting foot 55 is attached to a vertically slidable bar 56. A rotatably journalled pinion 57 mounted on a middle portion of the bar 56 engages a second rack 58 of the sleeve 49 and a third rack 59 of an arm 60 connected to the bracket 54 and thereby fixed to the presser bar 42. The second and third racks 58, 59 together with the pinion 57 form a differential gear controlling vertical movement of the bar 56 and the supporting foot 55, as will be described below.

In FIG. 5, the presser foot 43 is in an elevated, non-operative position. Adjustment to this position takes place by sliding the sleeve 49 upwards by action of the stepping motor driven pinion 51 and the first rack 50 until the sleeve 42 engages the bracket 54. Upward movement of the sleeve 49 also raises the bar 56, due to engagement of the second rack 58 with the pinion 57.

During further upward movement, the sleeve 42 will entrain or force the presser bar 42 upwardly, thereby raising the presser foot 43 to the illustrated position. During such further upward movement, the second and third racks 58, 59 will move upwardly in a simultaneous and parallel fashion. By simultaneous and parallel raising of the second and third racks 58, 59, the pinion 57 is entrained between the racks 58, 59, whereby the bar 56 and the supporting foot 55 will also be further raised to the illustrated position.

A sewing procedure in accordance with the second embodiment is illustrated in FIGS. 6 and 7. In FIG. 6, the presser foot 43 has been lowered, the needle 41 is in its elevated position, and the feed dog 44 has just completed a fabric feeding stroke. The presser foot 43 is in a horizontally displaced position. The presser foot pressure is controlled by tensioning the presser spring 53 by means of the rack 50, pinion 51, sleeve 42, and bracket 52. The supporting foot 55 is held in a raised position by the differential gear 57, 58, 59 and, therefore, does not obstruct feeding of the fabric.

In FIG. 7, the needle 41 is shown in its lowermost position and the sleeve 49 has been moved further downwards whereby the supporting foot 55 has been lowered to engage the fabric. The presser foot 43 is in an elevated position and has been returned to its initial horizontal position by action of the springs 48, as illustrated.

Upward movement of the presser foot 43 is provided by the differential gear 57, 58, 59 by sliding the sleeve 49 a further distance downwards while the supporting foot 55 engages the fabric. Due to this engagement, downward movement of the sleeve 49 is transformed, via the pinion 57, into an upward movement of the arm 60 which, in turn, raises the presser bar 42 to the illustrated position. Thus, engagement of the supporting foot 55 on the fabric is used to raise the presser foot 43. It is thereby ensured that the supporting foot 55 holds the fabric in a fixed position during raising and lowering of the presser foot 43, whereby undesired sliding of the fabric is prevented.

In the second embodiment of the present invention, the fabric will be alternatingly held by the presser foot 43 and the supporting foot 55 during the entire sewing procedure. It is thereby further ensured that the fabric will not be displaced in an undesirable manner, and the supporting foot 55 also prevents possible turning or rotation of the fabric around the needle 41 during raising of the presser foot 43.

FIGS. 8–11 show a third embodiment of the present invention adapted for pleat or tuck sewing which is controlled by a stepping motor driven presser bar 12 (FIGS. 1–4). The third embodiment comprises a presser foot 63 having a vertical leg 64 fixed to an upper bracket 65 which, in turn, is slidable on the presser bar 12. A lower bracket 66 is fixed to the presser bar 12. By raising the presser bar 12 until the lower bracket 66 engages the upper bracket 65 (FIGS. 9, 11) the presser foot 63 can be raised or moved upwardly from the underlying base.

A supporting plate 67 is provided relatively in front of the presser foot 63 and connected to the presser foot 63 by a spring 68. On top of the supporting plate 67 there is provided a reciprocatable top feed ruffler 69 which is attached to a rectangular frame 70. The frame 70 is articulatedly connected to the upper bracket 65 by means of a first pair of angled levers 71. The levers 71 are connected by means of pivot pins 72 to the upper end of a second pair of levers 73, the lower ends of which are connected to pivot pins 74 of the lower bracket 66. A first pair of tension springs 76, (one shown), extends between lower attachments 77 adjacent to the pivot pins 74 and upper attachments 78 on the levers 71. A second pair of tension springs extends between the rear end of the frame 70 and the pivot pins 72.

Figure 8:
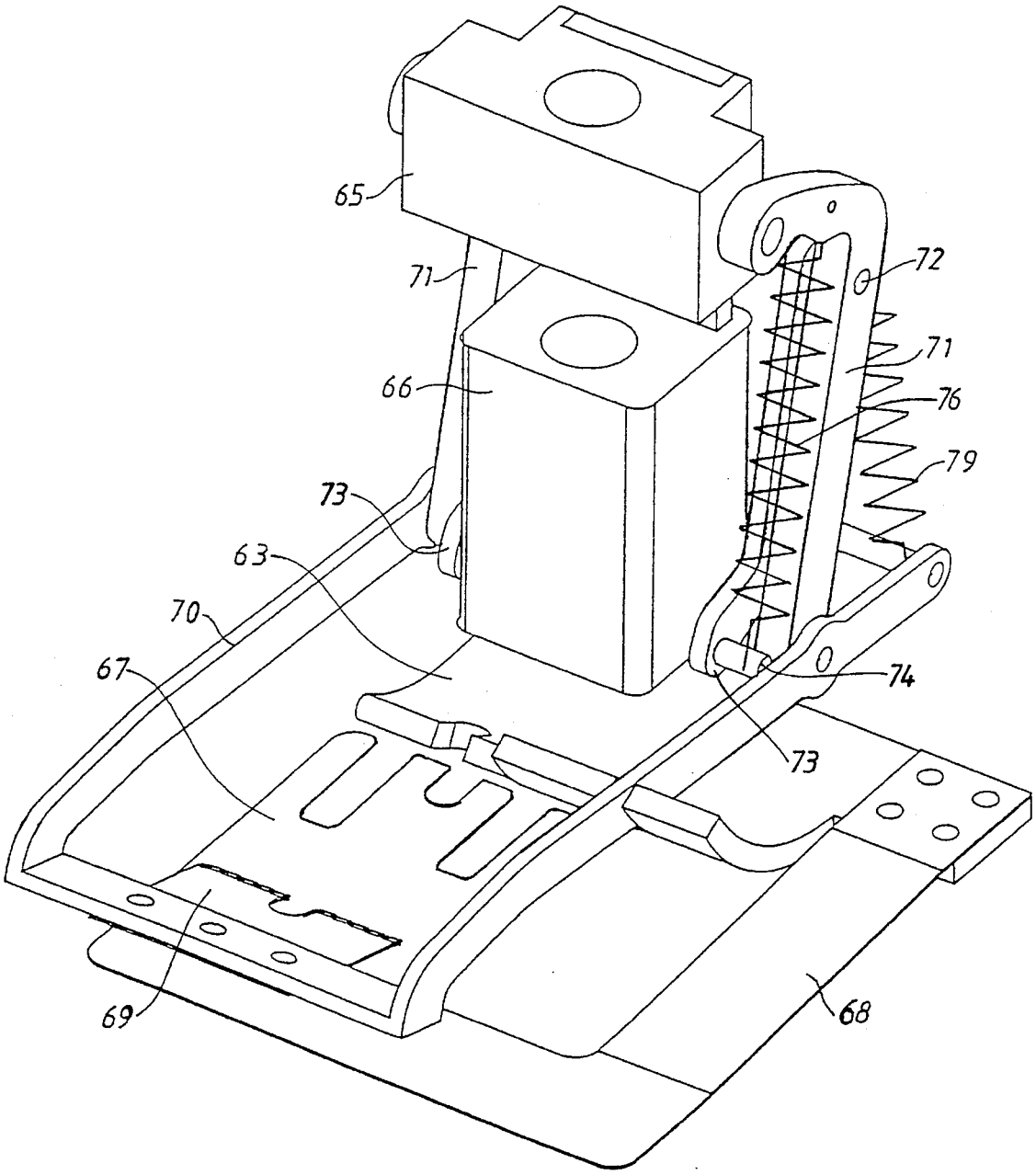
FIGS. 8 and 9 illustrate perspective views of a third embodiment of the present invention in two different positions.
Figure 9:
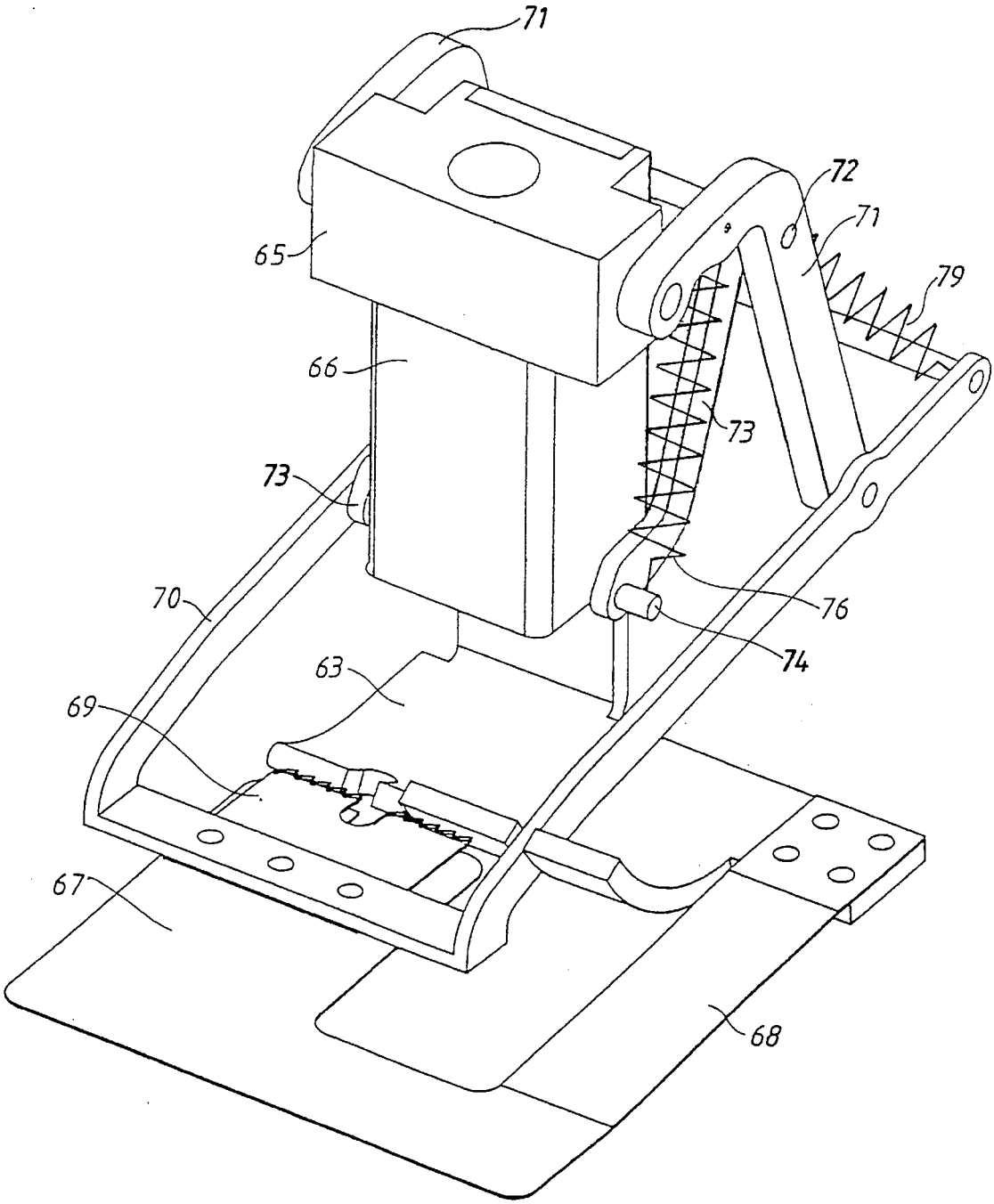
Figure 10:
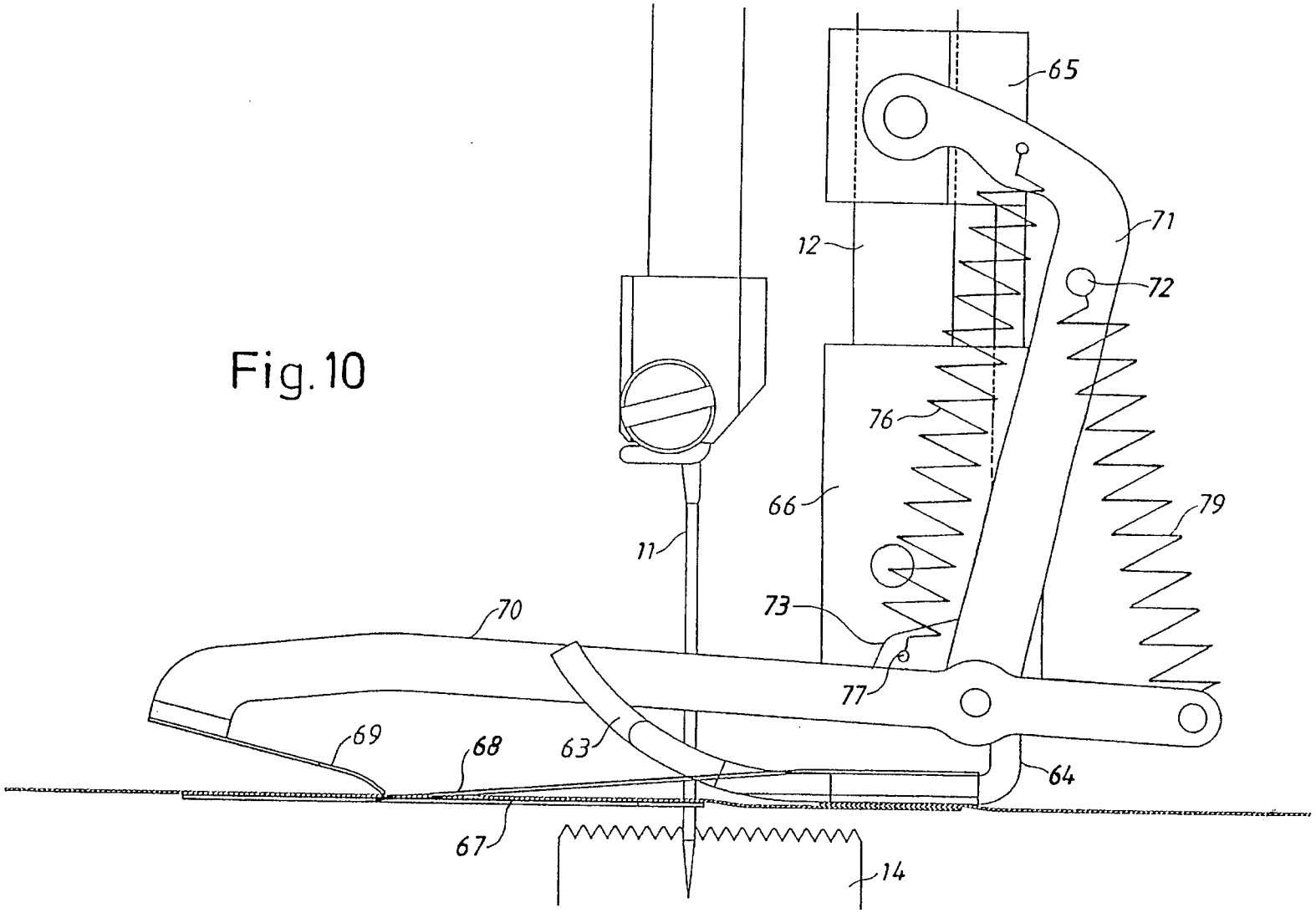
FIGS. 10 and 11 illustrate side elevational views of the third embodiment of the present invention in two different positions.
Figure 11:
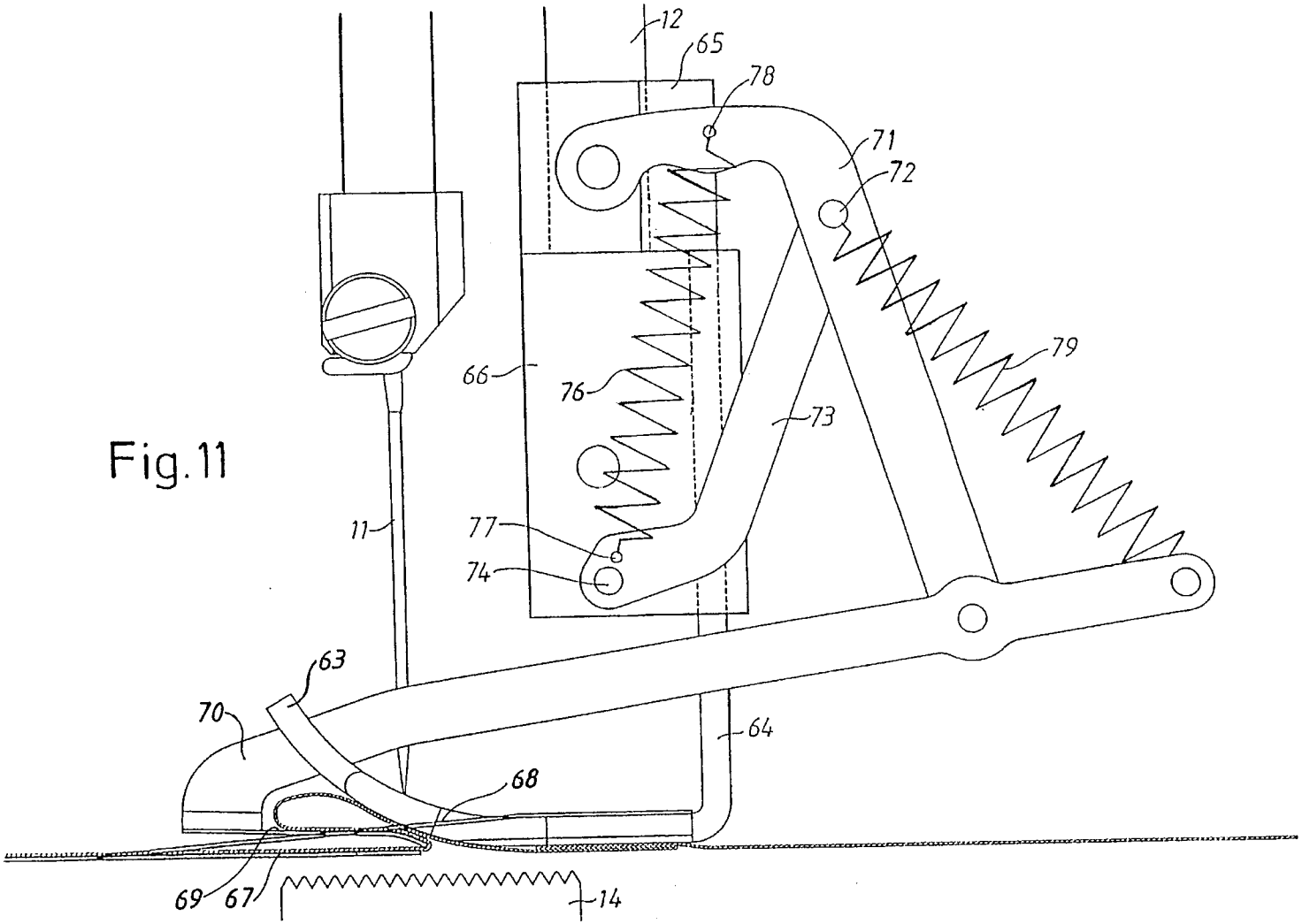

For tuck forming, the stroke of the feed dog 14 is set to zero when the needle 11 is in its lower position. To form a tuck of a desired length, the presser bar 12 and the lower bracket 66 are moved downwards whereby the frame 70 together with the top feed ruffler 69 are moved forward by the levers 71, 73. The top feed ruffler is held in engagement with the fabric by the springs 79. The desired tuck length is set by the control unit of the machine, and the position of the presser bar 12 and the top feed ruffler 69 is determined by an optical difference meter (not shown) of a known type. In FIGS. 8 and 10 the top feed ruffler 69 is shown in its maximum forward position which provides for a maximum tuck length. The pressure bar 12 is then returned upwards, and the top feed ruffler 69 returns to the position shown in FIGS. 9 and 11, and thereby entrains the fabric towards the needle 11, which in this stage is in its upward stroke, while simultaneously forming a tuck. The pressure bar 12 is raised to a position in which the presser foot 63 is raised slightly at the same time as the fabric tuck is inserted under it. The presser foot 63 is then lowered and the presser foot pressure is adjusted to a normal value, and the needle 11 is subsequently lowered. The top feed ruffler 69 remains in the position shown in FIGS. 9 and 11 during the descending movement of the needle 11, and thereby ensures that the needle 11 penetrates all of the three fabric layers. When the needle 11 is in a lower position, the feeding is adjusted to a preselected stitch length for sewing a number of normal stitches without tuck forming.

The tuck forming interval is adjusted by means of the control unit of the machine. The adjustment can be made in different ways. One possibility is to select a number of normal stitches between each tuck. It is also possible to set a number of tucks per unit of length, or a fabric contraction as a percentage of the fabric length.

When a tuck is formed, the fabric thickness below the presser foot increases which is sensed by the mentioned optical difference meter. In response to the sensed fabric thickness an automatic adjustment of the thread tension and the presser foot pressure is carried out in order to obtain the best sewing performance possible.

While the preferred embodiment of the present invention is shown and described herein, it is to be understood that the same is not so limited but shall cover and include any and all modifications thereof which fall within the purview of the invention.

What is claimed is:

1. An arrangement in a sewing machine, comprising a needle bar (10; 40) having a needle (11; 41), a feed dog (14; 44) for feeding a fabric to be sewn, and a vertically movable presser bar (12; 42) having a presser foot (13; 43; 63) and a presser spring (23; 53), said presser bar being actuated by a power-driven actuating means (19; 49) connected to said presser spring and slidable in parallel with said presser bar, said actuating means being movable relative to said presser bar to control the presser foot pressure and to engage the presser bar in order to raise and lower the presser foot during a sewing procedure in accordance with a predetermined program, wherein the presser foot is horizontally movable relative to the presser bar together with the fabric during feeding steps, said actuating means is operable to raise said presser foot independently of the needle bar, and said presser foot is actuated by resilient means in order to, when raised, be returned to an initial position relative to the presser bar.

2. Arrangement according to claim 1, wherein the presser foot is adapted to be raised when the needle (11) is in a lower position, whereby displacement of the fabric is prevented by the needle.

3. Arrangement according to claim 1, further comprising a vertically movable supporting foot (55) for holding the fabric when the presser foot (43) is raised, and a differential gear (57–59) actuated by the actuating means (49) for alternately raising said presser foot and said supporting foot.

4. Arrangement according to claim 3, wherein the actuating means (49) comprises a sleeve slidably mounted on the presser bar and having a first rack (50) engaging a first pinion (51) driven by a stepping motor, the differential gear comprising a second rack (58) connected to said actuating means, a third rack (59) connected to the presser bar (42), and a second pinion (57) engaging both said second and third racks and rotatably mounted on a bar (56) connected to the supporting foot (55).

5. Arrangement according to claim 1, further comprising a presser foot (63) having a top feed ruffler (69; 70) actuatable by the actuating means (19) via the presser bar (12) and horizontally reciprocatable to produce fabric tucks of a predetermined length.

6. Arrangement according to claim 5, further comprising a lower bracket (66) attached to the presser bar (12), and an upper bracket (65) slidably mounted on the presser bar and attached to the presser foot (63), said top feed ruffler (69; 70) being connected to said brackets (65; 66) by means of levers (71; 73) which transform vertical movement of the presser bar into horizontal movement of said top feed ruffler.

7. Arrangement according to claim 5, wherein the presser foot (63) is adapted to be raised in order to facilitate insertion of a fabric tuck thereunder.

* * * * *